US008433498B2

(12) United States Patent
Dintino et al.

(10) Patent No.: US 8,433,498 B2
(45) Date of Patent: Apr. 30, 2013

(54) METHOD AND SYSTEM FOR CONTROLLING FUEL PRESSURE

(75) Inventors: Maura Dintino, Turin (IT); Vincenzo Rampino, Turin (IT); Eugenio Pisoni, Turin (IT)

(73) Assignee: GM Global Technology Operations LLC, Detroit, MI (US)

( * ) Notice: Subject to any disclaimer, the term of this patent is extended or adjusted under 35 U.S.C. 154(b) by 248 days.

(21) Appl. No.: 12/876,955

(22) Filed: Sep. 7, 2010

(65) Prior Publication Data

US 2011/0106407 A1 May 5, 2011

(30) Foreign Application Priority Data

Sep. 8, 2009 (GB) ..... 0915644.9

(51) Int. Cl.
*F02D 41/08* (2006.01)

(52) U.S. Cl.
USPC ..... 701/103; 123/446; 123/447; 123/497

(58) Field of Classification Search ..... 123/446, 123/447, 497, 458, 506, 514; 701/102–104
See application file for complete search history.

(56) References Cited

U.S. PATENT DOCUMENTS

| | | | | |
|---|---|---|---|---|
| 5,715,797 | A * | 2/1998 | Minagawa et al. | 123/497 |
| 6,223,731 | B1 * | 5/2001 | Yoshiume et al. | 123/497 |
| 6,422,203 | B1 | 7/2002 | Djordjevic | |
| 6,446,610 | B1 * | 9/2002 | Mazet | 123/497 |
| 6,453,878 | B1 * | 9/2002 | Mazet | 123/497 |
| 6,484,696 | B2 * | 11/2002 | Barnes et al. | 123/446 |
| 6,694,953 | B2 * | 2/2004 | Barnes et al. | 123/500 |
| 6,712,045 | B1 * | 3/2004 | McCarthy, Jr. | 123/456 |
| 7,201,148 | B2 * | 4/2007 | Nakane | 123/456 |
| 7,216,628 | B2 * | 5/2007 | Hayakawa | 123/458 |
| 7,240,667 | B2 * | 7/2007 | Dolker | 123/456 |
| 7,287,516 | B2 * | 10/2007 | Elliot et al. | 123/500 |
| 2004/0055576 | A1 | 3/2004 | McCarthy, Jr. | |
| 2005/0081825 | A1 * | 4/2005 | Suenaga et al. | 123/446 |
| 2007/0023009 | A1 * | 2/2007 | Elliott et al. | 123/446 |
| 2007/0125343 | A1 * | 6/2007 | Hayakawa | 123/447 |
| 2007/0144490 | A1 * | 6/2007 | Serra et al. | 123/458 |
| 2010/0307459 | A1 * | 12/2010 | Steinbach et al. | 123/511 |

FOREIGN PATENT DOCUMENTS

| | | | |
|---|---|---|---|
| EP | 2116710 | A1 | 11/2009 |
| JP | 2003301759 | A | 10/2003 |

OTHER PUBLICATIONS

USPTO, Great Britain Search Report dated Dec. 16, 2009 for Application No. GB0915644.9.

* cited by examiner

*Primary Examiner* — Stephen K Cronin
*Assistant Examiner* — Joseph Dallo
(74) *Attorney, Agent, or Firm* — Ingrassia Fisher & Lorenz, P.C.

(57) ABSTRACT

Methods, a fuel supply system, and a computer readable medium embodying a computer program product are provided for controlling rail pressure in a fuel supply system comprising a fuel pump, an injector and a rail connecting the injector to the pump. At least one of the methods includes, but is not limited to establishing a relationship between said rail pressure and a leak rate of the injector, estimating a fuel drain rate from said rail based on a fuel injection rate, the rail pressure and said rail pressure/leak rate relationship, estimating a desired intake flow rate of said pump based on said fuel drain rate, and controlling the pump to operate at said desired intake flow rate.

15 Claims, 4 Drawing Sheets

METHOD AND SYSTEM FOR CONTROLLING FUEL PRESSURE

CROSS-REFERENCE TO RELATED APPLICATION

This application claims priority to British Patent Application No. 0915644.9, filed Sep. 8, 2009, which is incorporated herein by reference in its entirety.

TECHNICAL FIELD

The present invention relates to a method for controlling supply rail pressure in a fuel supply system, in particular for a Diesel engine, and to devices for carrying out the method.

BACKGROUND

Conventionally the fuel supply system of a Diesel engine comprises a fuel pump capable of delivering high output pressures of up to 1600 bar, an injector associated to each cylinder of the engine and a rail connecting the injector to the pump. The injector comprises a solenoid or a piezo element for electrically controlling a pilot valve. The pilot valve controls a flow of fuel to pressure-receiving surfaces of a valve piston, so that a tip of the valve piston is either pressed against ejection nozzles of the injector and blocks these or is withdrawn, allowing fuel to be ejected from the nozzles. Due to this principle of operation, only a fraction of the fuel that flows into the injector is actually injected into the cylinder. Fuel that has been used for driving the valve piston flows back to the tank, and so does fuel which escapes through internal leaks of the injector.

Fuel efficiency and pollutant emission rates depend critically on fuel injection timing. Not only must a predetermined quantity of fuel be injected into the cylinders at each engine stroke, but it must also happen at the right time interval (or intervals) during a stroke. Since the flow rate through the injector depends on the rail pressure (and other quantities), injecting the predetermined quantity of fuel may take longer than desired if the rail pressure is too low, or injection may stop earlier than desired if the rail pressure is too high. Further, atomization of the fuel depends on rail pressure. Non-optimal atomization may cause pollutant emission to increase and/or fuel efficiency to decrease. The fuel pressure that yields ideal atomization depends on the operating conditions of the engine, so that when these vary, the fuel pressure has to be adapted. For these reasons it is very important to control the fuel pressure. This must be done by controlling the operation of the pump so that at any time its delivery rate equals the rate at which fuel is drained from the rail by the injectors. The fuel drain rate is a rather complex function of operating conditions, since not only the engine speed, i.e., frequency of fuel injections may vary, but also the amount of fuel injected per engine stroke, and the leak rate of the injector depends on the duration of its excitation phases. Further, even if the fuel drain rate from the rail was exactly known, a pump can generally not be straightforwardly controlled to deliver this drain rate, since the pump also has internal leakage rates depending on input and output pressures and on fuel temperature, so that there is no one-to-one relationship between pump speed and delivery rate.

Conventionally, this problem is handled by experimentally analyzing the behaviour of the complete fuel supply system under a variety of operating conditions and tuning the control of the pump so that an appropriate fuel rail pressure is maintained in all operating conditions. This analysis and tuning has to be redone every time when the fuel supply system is modified, e.g., by replacing an injector or the fuel pump by one of a different type, requiring considerable amounts of labour.

At least one object of the present invention is to provide a control method and devices for carrying out the method which facilitate the integration of components having different characteristics into the fuel supply system. A further object of the invention is a controller for carrying out the control method and another object of the invention is a data processor program product. Furthermore, other objects, desirable features, and characteristics will become apparent from the subsequent summary and detailed description, and the appended claims, taken in conjunction with the accompanying drawings and this background.

SUMMARY

The at least one object is achieved by a method for controlling rail pressure in a fuel supply system comprising a fuel pump, at least one injector and a rail connecting the injector to the pump, the method comprising the steps of a) establishing a relationship between said rail pressure and a leak rate of the injector; c) estimating a fuel drain rate from said rail based on a fuel injection rate, said rail pressure and said rail pressure-leak rate relationship, d) estimating a desired intake flow rate of said pump based on said fuel drain rate; and e) controlling the pump to operate at said desired intake flow rate.

Instead of analyzing the fuel supply system as a whole, according to the present invention the experimental analysis is carried out separately for the components of the fuel supply system. The relationship between the rail pressure and the injector leak rate is easier to analyze than the behaviour of the entire system since the former is independent of all characteristics of the pump. If an injector has to be replaced, the rail pressure-leak rate relationship has to be established again for the new injector, but characteristics of the pump remain unchanged. Vice versa, if only the pump is exchanged, there is no need to update the rail pressure-leak rate relationship. Preferably, a relationship between the rail pressure and an efficiency of the pump is also established experimentally prior to steps c) to e), and the thus determined relationship is taken into account for estimating the desired intake flow rate in step d).

Since viscosity of the fuel depends on its temperature, the rail pressure-leak rate relationship should be established as a function of fuel temperature. Although the fuel is heated when decompressed in the leaks of the pump and the injector, a single measure of the fuel temperature, e.g., at the pump input, may be sufficient since for a given input temperature the amount of fuel temperature increase is determined by the rail pressure.

The leak rate of the injector varies depending on the excitation state of the pilot valve. Since the duty cycle of the pilot valve is a function of engine speed, the rail pressure-leak rate relationship should preferably specify the leak rate as an engine speed-weighted sum of at least a static leak rate associated to the closed state of the injector and a dynamic leak rate associated to its open state.

Preferably, the rail pressure-leak rate relationship, in particular the dynamic leak rate, should be established as a function of injector excitation time, since the instantaneous leak rate of the injector in the excited state of the pilot valve is often found not to be constant but to be a function of how long the pilot valve has been excited.

At an excitation time of zero, i.e., for the static component of the leak rate, it is surprisingly found that the leak rate increases more than linearly with the rail pressure. This is surprising since due to the small clearance through which the fuel flows, the leak flow through the injector should be laminar and the leak rate $G_{st}$ should therefore be described by Poiseuille's formula $$G_{st} = \frac{K}{\gamma}\Delta p,$$

Where K denote a geometry-dependent factor and γ the viscosity of the fuel, i.e., the leak rate $G_{st}$ should be directly proportional to the pressure drop Δp (which substantially equals the rail pressure. In practice, the relationship between the leak rate $G_{st}$ and the rail pressure p is not described correctly be this formula, probably due to the viscosity of the fuel being reduced while heating up due to decompression in the injector.

As pointed out already, the dynamic leak rate may depend on excitation time. In particular, the dynamic leak rate may be found to increase with the excitation time at a first, high rate if the excitation time is below a given threshold and to increase with the excitation time at a second, low rate if the excitation time is above said given threshold. This can be attributed to the fact that while the excitation time is below the threshold, a displaceable member of the pilot valve is being displaced by fuel flowing through the pilot valve and does as such not obstruct the flow of the fuel. When the displaceable element has reached an abutment (and the injector is fully open), the displaceable element becomes an additional obstacle to the fuel flow through the pilot valve, so that the instantaneous flow rate through the pilot valve is reduced.

According to an alternative embodiment, the at least one object is achieved by a method for controlling rail pressure in a fuel supply system comprising a fuel pump, at least one injector and a rail connecting the injector to the pump, comprising the steps of b) establishing a relationship between said rail pressure and an efficiency of said pump, c) estimating a fuel drain rate from said rail based at least on a fuel injection rate, d) estimating a desired intake flow rate of said pump based on said fuel drain rate and said efficiency; and e) controlling the pump to operate at said desired intake flow rate. Due to the fuel viscosity depending on temperature, the rail pressure-leak rate relationship is preferably established as a function of fuel temperature, too.

Although the estimate obtained in step d) will be rather close to the actual intake flow rate of the pump required to maintain the rail pressure at a desired constant value, small deviations may cause the rail pressure to drift slowly. Such a slow drift can be compensated by step e) comprising e1) inputting to said pump a control parameter determined based on said desired intake flow rate, e2) detecting a deviation between a current rail pressure and a target rail pressure, and e3) correcting said control parameter depending on said deviation. In this way, the control parameter input in step e1) is obtained in an open control loop in a very short time, enabling to react quickly to variations of the fuel drain rate caused by the variations of engine load and/or speed, whereas a fine control of the pump operation is carried out in a closed loop in steps e2) and e3).

A controller is provided in accordance with an embodiment of the invention for carrying out the method as described above, the controller comprising a feed-forward unit for carrying out steps a) to d) and a feedback unit for carrying out step e). A data processor program product comprising program code means for enabling a data processor to form at least the feed-forward unit of the above described controller or to carry out the method as described above. This data processor program product may further comprise a data carrier in which said program code means are recorded in machine readable form.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
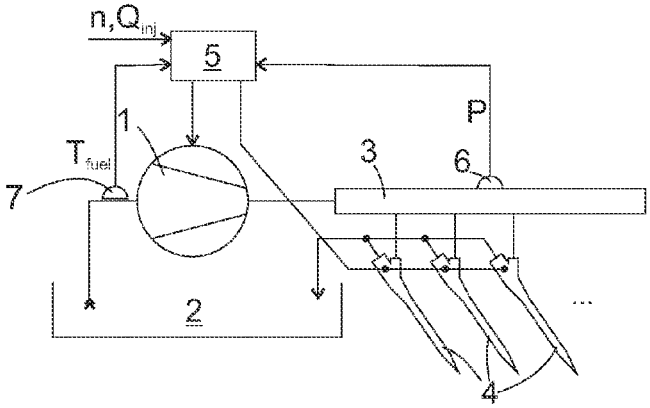
FIG. 1 is a block diagram of a fuel supply system.

FIG. 1 is a schematic outline of a fuel supply system of a Diesel engine in which the present invention is applicable. A fuel pump 1, e.g., a gear pump or a pump having multiple pistons driven by a same rotating excenter, draws fuel from a tank 2 and supplies it at high pressure to a rail 3. The rail 3 has an arbitrary number of injectors 4 connected to it for injecting fuel from rail 3 into cylinders of a Diesel engine, not shown. An electronic controller 5 controls the rotation speed of pump 1 and excitation times of injectors 4 based on fuel temperature $T_{fuel}$ and rail pressure P detected by sensors 6, 7 at the fuel rail 3, a rotation speed n of the diesel engine and a fuel injection quantity $Q_{inj}$ to be injected per cylinder and per engine stroke, set by a higher level controller, not shown.

Figure 2:
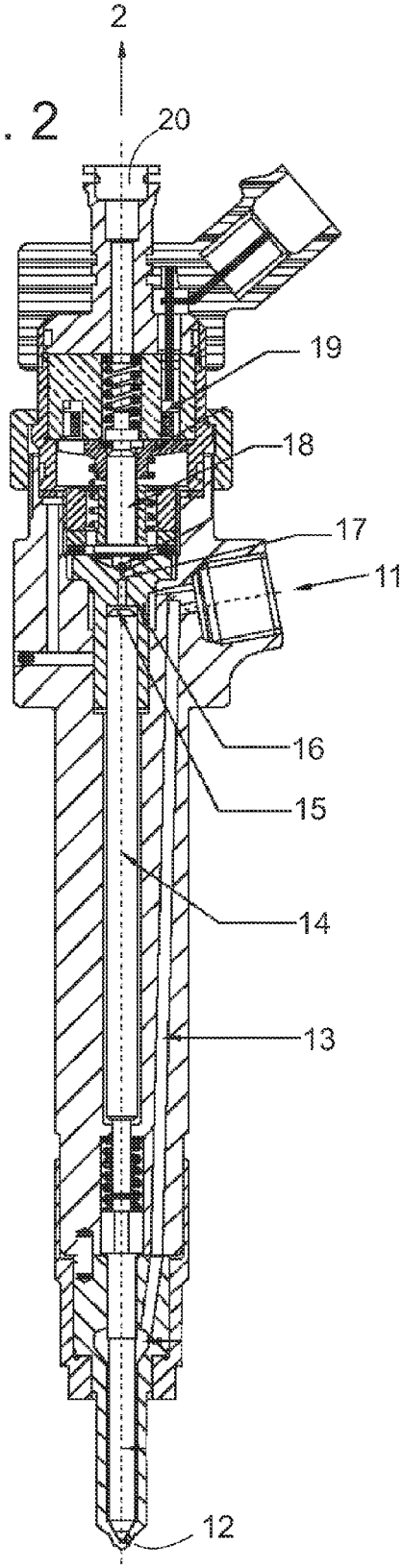
FIG. 2 is a section of an injector of the fuel supply system of FIG. 1.

FIG. 2 is a schematic longitudinal section of one of injectors 4. A high pressure fuel inlet 11 which receives fuel from rail 3 is connected to an injection nozzle 12 at the bottom end of injector 4 by a feed pipe 13. In the configuration shown, output of fuel at nozzle 12 is blocked by a conical tip of a control piston 14. At an end of control piston 14 opposite to said tip there is a control chamber 15 which communicates with fuel inlet 11 via a small feed orifice 16. Pressurized fuel in control chamber 15 urges control piston 14 downward. The control piston 14 is shaped so that if pressures at the tip of piston 14 and in control chamber 15 are equal, a net downward force keeps the piston 14 pressed against injection nozzles 12.

The control chamber 15 has a bleed orifice 17 which at rest is held blocked by a pin element 18 of a pilot valve. If the pin element 18 is allowed to recede by exciting a solenoid 19 of the pilot valve, fuel escapes from control chamber 15 through bleed orifice 17, causing the pressure in control chamber 15 to drop, whereby control piston 14 is displaced upwards by the pressure acting on its bottom tip. The tip of the piston 14 is thus removed from the injection nozzles 12, and fuel is ejected from nozzles 12 into a combustion cylinder.

When the excitation of the solenoid 19 stops, pin element 18 is pressed against bleed orifice 17 again by means of a spring. In consequence, the pressure in control chamber 15 rises again and finally becomes sufficient to press the control piston 14 against the injection nozzles 12 again.

While the injection nozzles 12 are blocked, fuel may escape from high pressure regions of the injector to a return port 20 thereof and from there back to tank 2 via clearings, e.g. along control piston 14. In addition, when the solenoid 19 is excited, fuel that escapes through bleed orifice 17 will reach the return port 20. Thus the total flow of fuel through injector 4 can be regarded as made up of three contributions, firstly a flow which is indeed injected into the combustion cylinder, secondly a static leakage flow which may be defined as that portion of a total leakage flow which exists regardless of whether the solenoid 19 is excited or not, and a dynamic leakage flow which is made up of the fuel used for driving the displacement of pin element 18 or which escapes through leaks inside the injector which exist only when the solenoid 19 is excited and the control piston 14 is displaced from its rest position shown in FIG. 2.

Figure 3:
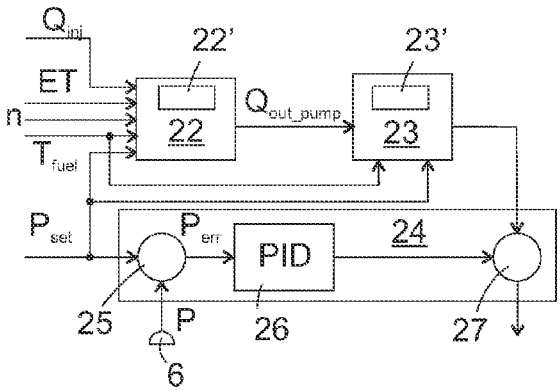
FIG. 3 is a block diagram of the controller of the fuel supply system.

FIG. 3 is a block diagram of the controller 5. For ease of description, the controller 5 is shown divided into three controller units 22, 23, 24, any of which might be implemented by hardware of its own. In most practical embodiments, however, it is to be expected that each control unit will be implemented as a software module, and that all modules are executed on a same hardware.

First open loop controller unit 22 receives from a higher level engine controller, not shown, data $Q_{inj}$ specifying an amount of fuel to be injected into each cylinder of the engine during an engine stroke, and an excitation time ET specifying for how long an excitation current will be supplied to solenoid 19 during said stroke. It should be noted that both $Q_{inj}$ and ET can be thought of as scalar quantities if there is just one fuel injection per stroke, or as vectors in case of multiple injections, the components of the vectors specifying injection amounts and excitation times of each injection. A current engine speed n is supplied to control unit 22 by a rotation speed sensor at an output shaft of the engine, or a target value of the rotation speed n is delivered by said higher level controller. Fuel temperature data $T_{fuel}$ are provided by sensor 7.

Figure 4:
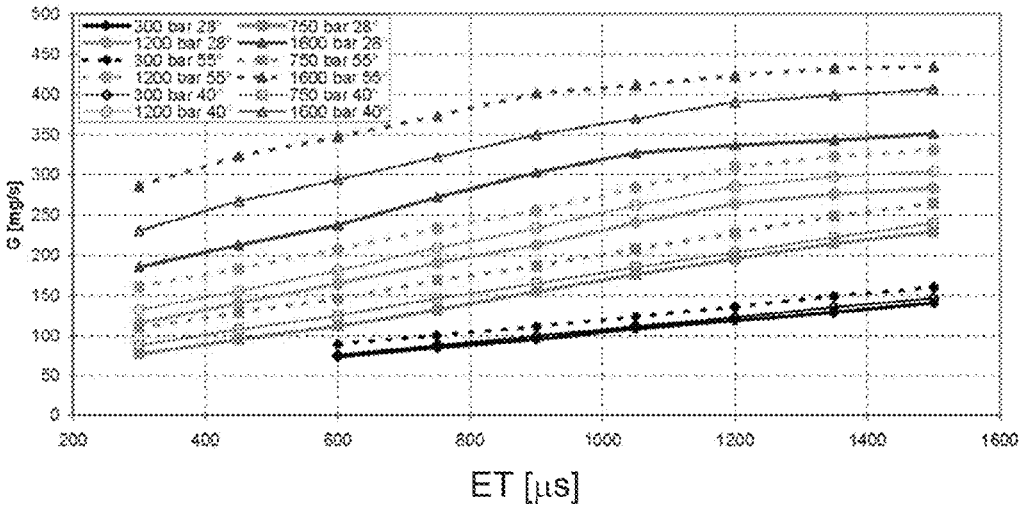
FIG. 4 is an example of experimental leakage rate data on which control of the fuel supply system is based.

Control unit 22 comprises a storage 22' in which a plurality of characteristics of static and dynamic leakage rate and, eventually, program instructions for controlling the operation of unit 22 are recorded. Such characteristics may be derived from experimental leakage rate data as shown exemplarily in FIG. 4. The curves shown in FIG. 4 illustrate average leakage rates under equilibrium conditions observed as a function of excitation time ET for various values of rail pressure, from 300 bar to 1600 bar and of the fuel temperature, from 28° C. to 55° C., at a constant rotation speed of the engine of e.g. n=1500 rpm. Quite clearly, for ET=0 the curves of FIG. 4 will give the static leakage rate.

Figure 5:
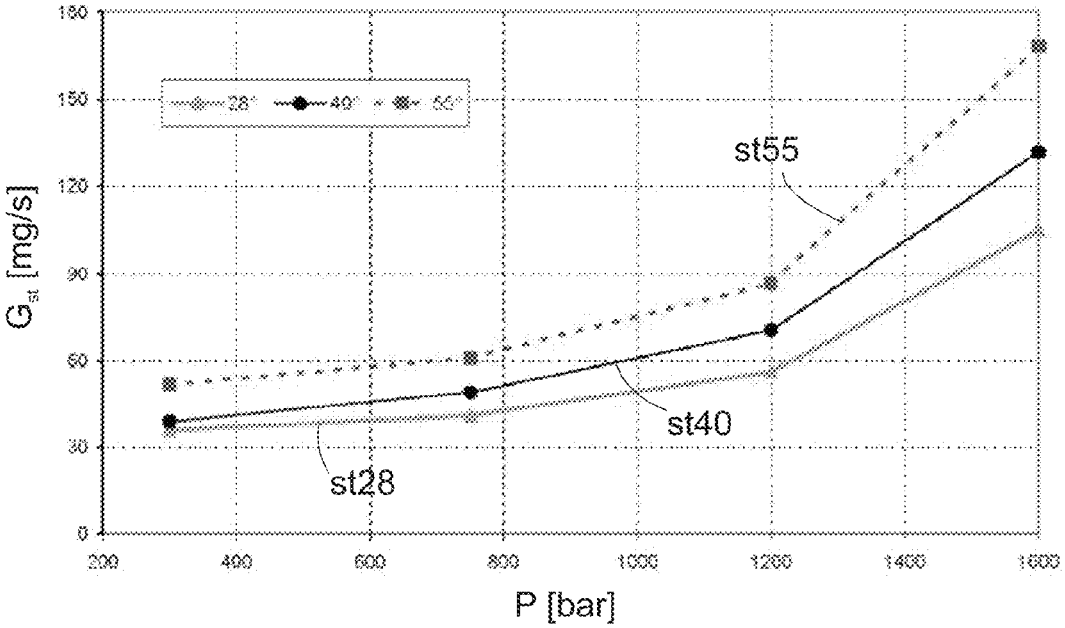
FIG. 5 illustrates static leakage rates as a function of rail pressure for various fuel temperatures.

FIG. 5 is a typical example of characteristic curves st28, st40, st55 of static leakage rates $G_{st}$ of an injector 4 as a function of rail pressure P for fuel temperatures 28° C., 40° C. and 55° C., as will be recorded in the storage 22' of control unit 22. It can be seen that the leakage rate $G_{st}$ increases with fuel temperature $T_{fuel}$ since viscosity of the fuel decreases when it is heated. What is unexpected is the pressure dependency of the static leakage rates. Theoretically, the flow rate of a laminar flow should be governed by Poiseuille's formula $$G_{st} = \frac{K}{\gamma}\Delta p,$$

Where K denotes a geometry-dependent factor and γ the viscosity of the fuel, and the pressure drop Δp in the injector 4 can be regarded as equal to the rail pressure P, i.e., the leakage rate $G_{st}$ should be directly proportional to the rail pressure P. It is quite clear from FIG. 5 that this equation doesn't give a satisfactory description of the leakage rate $G_{st}$. The actual increase of the leakage rate $G_{st}$ with the rail pressure P is much more pronounced than any of the two formulas predicts. The reason for this is that decompression of the fuel in the injector is not isothermal. Diesel fuel has a negative Joule-Thomson coefficient, so that decompression will cause it to heat up. The amount of heating and its effects on the leakage rate depend in a complex fashion on the shape of the leakage paths, and on the speed at which the heat generated in the fuel is dissipated. Quite clearly, the dependence of the static leakage rate $G_{st}$ of a given injector on fuel temperature $T_{fuel}$ and rail pressure P is best determined by experiment.

At any given fuel temperature $T_{fuel}$ and rail pressure P, the discrepancy between the static leakage rates $G_{st}$ of FIG. 5 and the measurement data of FIG. 4 corresponds to the dynamic leakage. Characteristics recorded in the storage 22' of control unit 22 specify the dynamic leakage amount $\Delta m_{dyn}$ in terms of the fuel mass leaking per injection event. The leakage amount $\Delta m_{dyn}$ is straightforwardly calculated from the experimental data of FIG. 4 by subtracting the static leakage rate $G_{st}$ and dividing the result by the number of injections per unit of time, i.e., by n.

Figure 6:
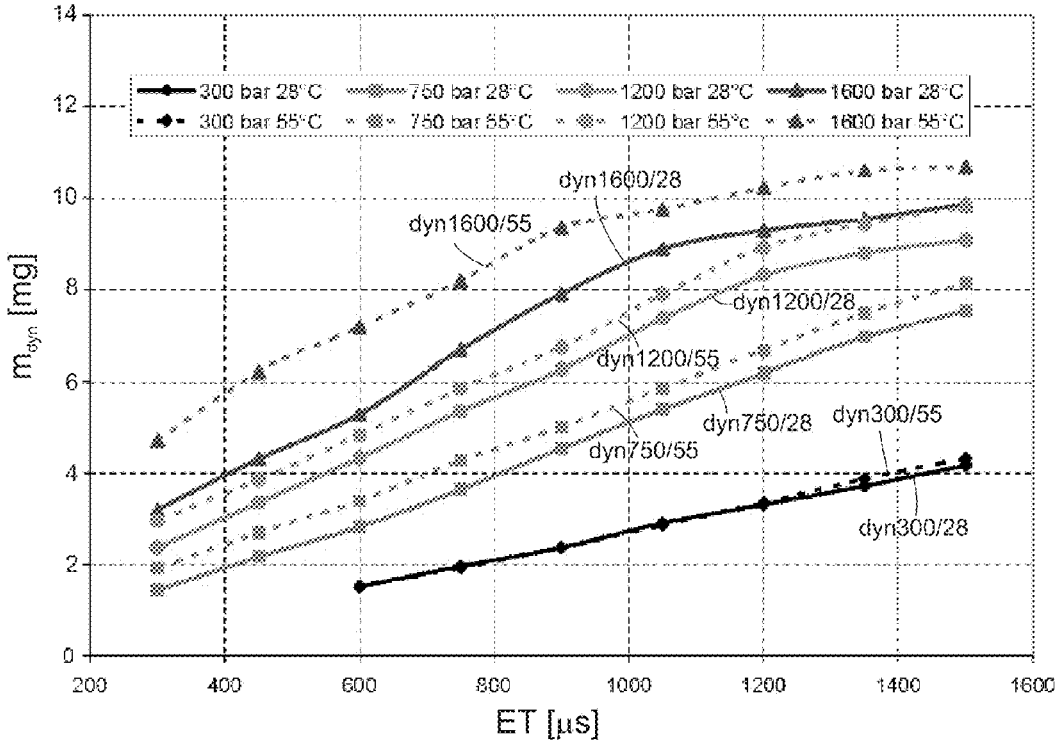
FIG. 6 illustrates dynamic leakage rates as a function of excitation time for various values of fuel temperature and rail pressure.

FIG. 6 exemplarily illustrates such characteristics dyn300/28, dyn300/55, dyn750/28, . . . , dyn1600/55 for various fuel pressures and temperatures as a function of excitation time ET. At low rail pressure values of 300 bar or 750 bar, the leakage amount $\Delta m_{dyn}$ appears to increase linearly with excitation time over the entire range of ET shown. At a rail pressure of 1200 bars, the slope of the leakage amount curves dyn1200/28, dyn1200/55 decreases above an excitation time of 1200 μs, and at 1600 bars, a decrease of the slope of curve dyn1600/28 is seen at ET=approx. 1000 μs for a fuel temperature of 28° C., and at ET=approx. 900 μs for a fuel temperature of 55° C. in curve dyn1600/55. The reason for this is believed to be in the internal structure of the injector 4: as long as the pilot valve pin element 18 is pushed upwards by the fuel escaping through bleed orifice 17, it does not constitute an obstacle to the dynamic leakage at bleed orifice 17. The dynamic leakage rate is therefore determined mainly be the width of bleed orifice 17 and the fuel temperature there. The time needed by pin element 18 to reach an abutment is the shorter, the higher the flow rate through bleed orifice 17 is, i.e., the higher fuel pressure P and temperature $T_{fuel}$ are. When pin element 18 has reached the abutment, it forms a further obstacle to the flow of fuel, and the flow rate through bleed orifice 17 will decrease. The dynamic leakage amount $\Delta m_{dyn}$ shown in FIG. 6, being an integral of the flow through bleed orifice 17, will exhibit a reduced increase rate when the pin element 18 has reached its abutment.

Figure 7:
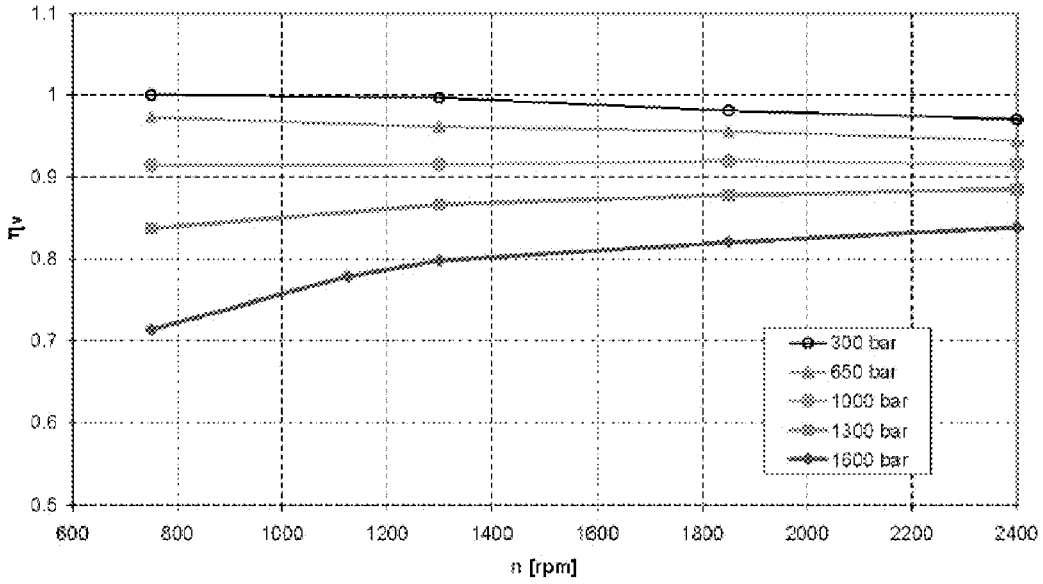
FIG. 7 is an example of efficiency characteristics of the fuel pump as a function of engine speed at various values of the rail pressure and a fuel temperature of 40° C.

In case of a fuel supply system with a single injection per stroke, control unit 22 will look up the dynamic leakage characteristics of FIG. 7 at the values of excitation time ET, fuel temperature $T_{fuel}$ and rail pressure P received by it, and will multiply the thus determined value of the leakage amount $\Delta m_{dyn}$ by the rotation speed n in order to calculate a dynamic leakage rate $G_{dyn}$ in terms of mass per time unit.

In case of a multi-injection system, leakage amounts may be looked up from the characteristics of FIG. 6 for each injection of a same stroke, taking account of the individual excitation time ET which may be different for the various injections, and the sum of the leakage amounts of the individual injections gives a total leakage amount $\Delta m_{dyn}$ per injector and stroke.

A dynamic leakage rate $G_{dyn}$ is obtained in control unit 22 by multiplying the leakage amount $\Delta m_{dyn}$ by the number of strokes per time unit, i.e. by the rotation speed n. The control unit 22 calculates a desired delivery rate $Q_{out_pump}$ of pump 1 as the sum of specified injection flow rates $Q_{inj}$ and total leakage rates $G_{st}$ and $G_{dyn}$ of the injectors 4 at given operating conditions n, $T_{fuel}$ and $P_{set}$.

Figure 8:
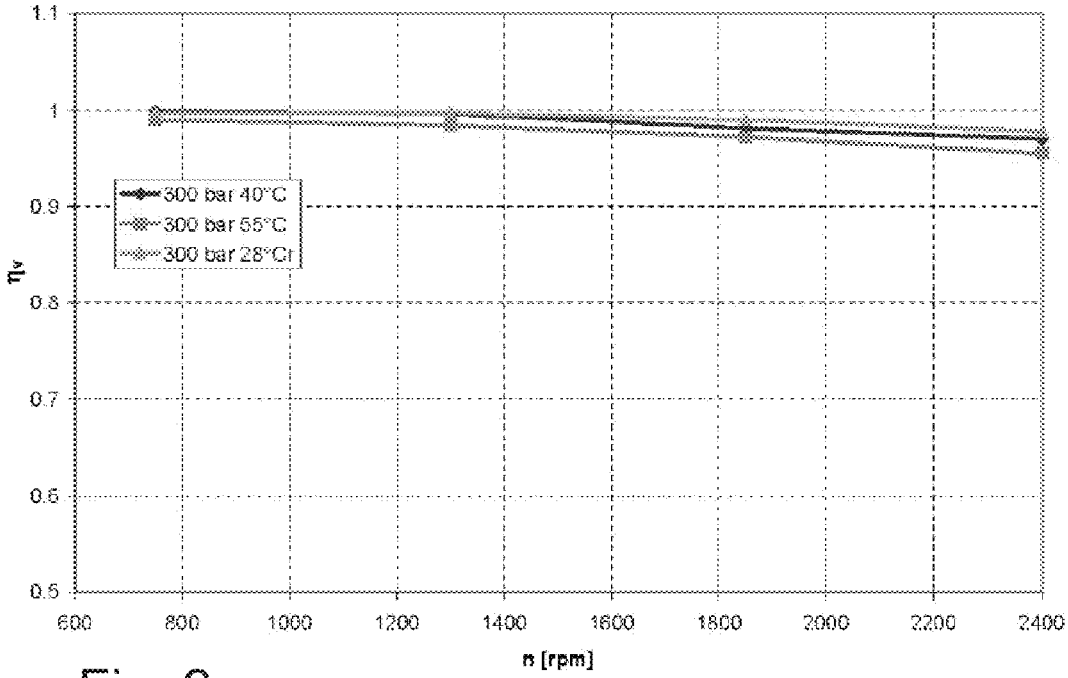
FIG. 8 illustrates characteristics of the pump efficiency at various fuel temperatures and a rail pressure of 300 bar.
Figure 9:
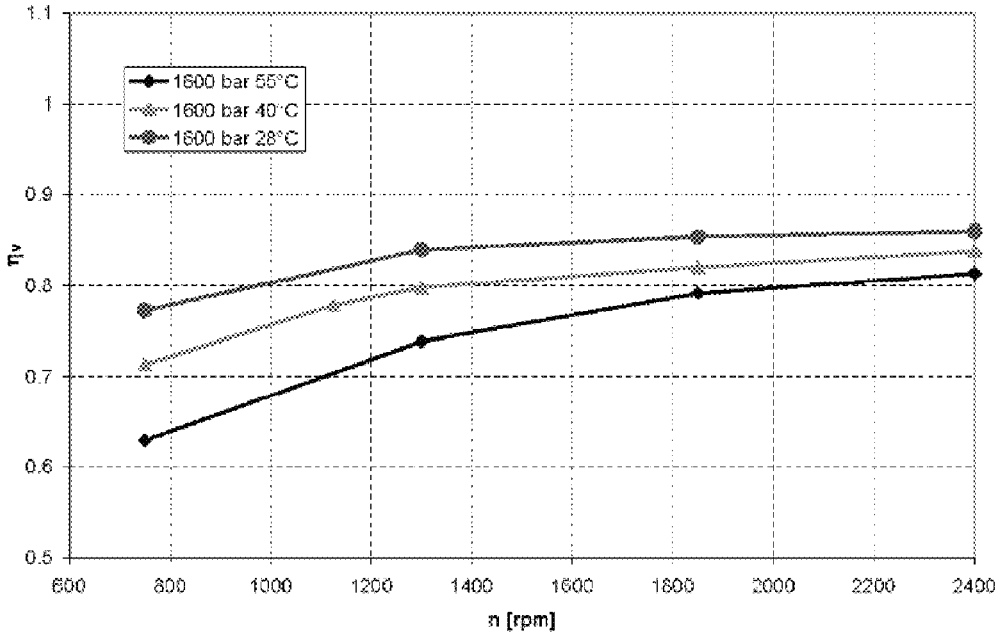
FIG. 9 illustrates efficiency characteristics at various fuel temperatures and a rail pressure of 1600 bar.

A second control unit 23 receives the desired delivery rate $Q_{out_pump}$, $T_{fuel}$ and $P_{set}$. Control unit 23 comprises a storage 23' with efficiency characteristics of fuel pump 1 stored therein. Just like the leakage characteristics of the injectors 4, these efficiency characteristics may be determined for a particular type of fuel pump by experiment. FIGS. 7 to 9 show typical examples of such characteristics. In FIG. 7, the efficiency is shown as a function of pump rotation speed for different rail pressures P and a temperature $T_{fuel}$ of 40° C. Quite expectedly, the efficiency η decreases with pressure P. Surprisingly, however, the efficiency η is observed to decrease with pump rotation speed at low values of the rail pressure P whereas at high pressure values it increases. This latter effect is quite independent of the fuel temperature as evidenced by FIGS. 8 and 9, which show the efficiency η as a function of pump rotation speed for different fuel temperatures $T_{fuel}$ at a rail pressure P of 300 bar in case of FIG. 8 and of 1600 bar in case of FIG. 9.

Based on the stored pump efficiency characteristics, control unit 23 outputs a control parameter to fuel pump 1 in order to deliver the desired flow rate $Q_{out_pump}$ at its output side. In most practical embodiments, this control parameter will be a target rotation speed of the pump 1.

Since this target rotation speed is determined in an open control loop, an updated value of it is available at minimum delay whenever the operating conditions of the Diesel engine change. Fluctuations of the rail pressure P due to changes of the desired injection quantity $Q_{inj}$, the engine speed n etc. can thus be kept at a very low level.

In order to avoid long-term deviation between the target rail pressure $P_{set}$ and the actual pressure P, the third control unit 24 establishes a closed loop control: a subtractor 25 determines a deviation $P_{err}$ between the rail pressure P and its target value $P_{set}$ and provides it to PID controller 26. A correction term output by PID controller 26 is superimposed upon the control signal from control unit 23 by adder 27, and pump 1 is controlled using the output of adder 27. In this way, the high response speed of open loop control is combined with the precision and freeness from drift of closed loop control.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A method for controlling a rail pressure in a fuel supply system comprising a fuel pump, at least one injector and a rail connecting the at least one injector to the fuel pump, comprising the steps of:

calculating a static leak rate of the at least one injector based on said rail pressure and a temperature of the fuel, the static leak rate being independent from an excitation time of the at least one injector;

calculating a dynamic leak rate of the at least one injector based on the static leak rate and the excitation time of the at least one injector;

establishing a relationship between said rail pressure and an engine-speed weighted sum of at least the static leak rate and the dynamic leak rate of the at least one injector;

estimating a fuel drain rate from said rail based on a fuel injection rate, said rail pressure and said relationship between said rail pressure and the engine-speed weighted sum of at least the static leak rate and the dynamic leak rate of the at least one injector;

estimating a desired intake flow rate of said fuel pump based on said fuel drain rate; and controlling the fuel pump to operate at said desired intake flow rate.

2. The method of claim 1, further comprising the step of establishing a relationship between said rail pressure and an efficiency of said fuel pump, wherein said relationship between said rail pressure and the efficiency of said fuel pump is taken into account for estimating the desired intake flow rate in the step of estimating the desired intake flow rate of said fuel pump based on said fuel drain rate.

3. The method of claim 1, wherein when the excitation time is 0, the dynamic leak rate increases more than linearly with the rail pressure.

4. The method of claim 1, wherein at a constant rail pressure the dynamic leak rate increases with the excitation time at a first, high rate if the excitation time is below a given threshold and increases with the excitation time at a second, low rate if the excitation time is above the given threshold.

5. A method for controlling a rail pressure in a fuel supply system comprising a fuel pump, at least one injector and a rail connecting the at least one injector to the fuel pump, comprising the steps of:

establishing a relationship between said rail pressure and an efficiency of said fuel pump;

calculating a static leak rate of said at least one injector based on said rail pressure and a temperature of the fuel, the static leak rate being independent from an excitation time of said at least one injector;

calculating a dynamic leak rate of the at least one injector based on the static leak rate and the excitation time of said at least one injector;

estimating a fuel drain rate from said rail based at least on a fuel injection rate, the static leak rate of said at least one injector and the dynamic leak rate of said least one injector;

estimating a desired intake flow rate of said fuel pump based on said fuel drain rate and said efficiency; and controlling the fuel pump to operate at said desired intake flow rate.

6. The method of claim 5, wherein said relationship between said rail pressure and the efficiency of said fuel pump is established as a function of fuel temperature.

7. The method of claim 5, wherein said controlling the fuel pump to operate at said desired intake flow rate comprises the steps of:

inputting to said fuel pump a control parameter determined based on said desired intake flow rate;

detecting a deviation between a current rail pressure and a target rail pressure; and correcting said control parameter depending on said deviation.

8. A fuel supply system, comprising:

a fuel pump;

an injector;

a rail connecting the injector to the fuel pump; and a controller that:

calculates a static leak rate of the injector based on a rail pressure and a temperature of the fuel, the static leak rate being independent from an excitation time of the fuel injector;

calculates a dynamic leak rate of the injector based on a sum of the static leak rates at each excitation time of the fuel injector for a same engine stroke;

establishes a relationship between the rail pressure and an engine-speed weighted sum of at least the static leak rate and the dynamic leak rate of the injector;

estimates a fuel drain rate from said rail based on a fuel injection rate, the rail pressure and said relationship between the rail pressure and the engine-speed weighted sum of at least the static leak rate and the dynamic leak rate of the injector;

estimates a desired intake flow rate of said fuel pump based on said fuel drain rate; and controls the fuel pump to operate at said desired intake flow rate.

9. The fuel supply system of claim 8, said controller further adapted to establish a relationship between said rail pressure and an efficiency of said fuel pump, wherein said relationship between said rail pressure and the efficiency of the fuel pump is taken into account for estimating the desired intake flow rate in the step of estimating the desired intake flow rate of said fuel pump based on said fuel drain rate.

10. The fuel supply system of claim 8, wherein when the excitation time of the injector is 0, the dynamic leak rate increases more than linearly with the rail pressure.

11. The fuel supply system of claim 8, wherein at a constant rail pressure the dynamic leak rate increases with the excitation time at a first, high rate if the excitation time is below a given threshold and increases with the excitation time at a second, low rate if the excitation time is above the given threshold.

12. A fuel supply system, comprising:

a fuel pump;

an injector;

a rail connecting the injector to the fuel pump; and a controller that:

establishes a relationship between a rail pressure and an efficiency of said fuel pump;

calculates a static leak rate of the injector based on a rail pressure and a temperature of the fuel, the static leak rate being independent from an excitation time of the fuel injector;

calculates a dynamic leak rate of the injector based on a sum of the static leak rates at each excitation time of the fuel injector for a same engine stroke;

estimates a fuel drain rate from said rail based at least on a fuel injection rate, the static leak rate of said at least one injector and the dynamic leak rate of the injector;

estimates a desired intake flow rate of said fuel pump based on said fuel drain rate and said efficiency; and controls the fuel pump to operate at said desired intake flow rate.

13. The fuel supply system of claim 12, wherein said relationship between said rail pressure and the efficiency of said fuel pump is established as a function of fuel temperature.

14. The fuel supply system of claim 12, wherein said controller is further adapted to:

transmit to said fuel pump a control parameter determined based on said desired intake flow rate;

detect a deviation between a current rail pressure and a target rail pressure; and correct said control parameter depending on said deviation.

15. A non-transitory computer readable medium embodying a computer program product, said computer program product comprising:

a control program for controlling a rail pressure in a fuel supply system comprising a fuel pump, at least one injector and a rail connecting the at least one injector to the fuel pump, the control program configured to:

calculate a static leak rate of the at least one injector based on said rail pressure and a temperature of the fuel, the static leak rate being independent from an excitation time of the at least one injector;

calculate a dynamic leak rate of the injector based on a sum of the static leak rates at each excitation time of the fuel injector for a same engine stroke;

establish a relationship between said rail pressure and an engine-speed weighted sum of at least the static leak rate and the dynamic leak rate of the at least one injector;

estimate a fuel drain rate from said rail based on a fuel injection rate, said rail pressure and said relationship between said rail pressure and the engine-speed weighted sum of at least the static leak rate and the dynamic leak rate of the at least one injector;

estimate a desired intake flow rate of said fuel pump based on said fuel drain rate; and control the fuel pump to operate at said desired intake flow rate.

* * * * *